US011229258B1

(12) United States Patent
Uzuegbunam

(10) Patent No.: US 11,229,258 B1
(45) Date of Patent: Jan. 25, 2022

(54) CONVERTIBLE SHOE

(71) Applicant: Uju Uzuegbunam, West Linn, OR (US)

(72) Inventor: Uju Uzuegbunam, West Linn, OR (US)

( * ) Notice: Subject to any disclaimer, the term of this patent is extended or adjusted under 35 U.S.C. 154(b) by 0 days.

(21) Appl. No.: 16/927,039

(22) Filed: Jul. 13, 2020

(51) Int. Cl.
*A43B 3/24* (2006.01)
*A43B 13/36* (2006.01)

(52) U.S. Cl.
CPC ..... *A43B 3/244* (2013.01); *A43B 3/246* (2013.01); *A43B 13/36* (2013.01)

(58) Field of Classification Search
CPC ..... A43B 3/24; A43B 3/244; A43B 3/246; A43B 13/36
USPC ..... 36/15, 100, 101
See application file for complete search history.

(56) References Cited

U.S. PATENT DOCUMENTS 3,059,350 A * 10/1962 Price ..... A43B 3/128 36/11.5
3,538,628 A * 11/1970 Einstein, Jr. ..... A43B 23/24 36/15
4,267,650 A * 5/1981 Bauer ..... A43B 13/36 36/101
4,279,083 A * 7/1981 Dilg ..... A43B 13/36 36/101
4,377,042 A * 3/1983 Bauer ..... A43B 13/36 36/101
5,542,198 A * 8/1996 Famolare ..... A43B 13/32 36/130
5,727,334 A * 3/1998 Cougar ..... A43B 1/0081 36/113
5,956,870 A * 9/1999 Grossman ..... A43C 15/14 36/127
5,996,252 A * 12/1999 Cougar ..... A43B 1/0081 36/113
6,389,712 B1 * 5/2002 Schelling ..... A43B 13/122 36/103
2001/0042319 A1 * 11/2001 Coomes ..... A43B 23/24 36/11.5
2003/0056395 A1 * 3/2003 Berggren ..... A43B 5/12 36/9 R
2003/0159314 A1 * 8/2003 Lewia ..... A43C 15/12 36/130
2004/0088883 A1 * 5/2004 Workman ..... A43B 13/36 36/15
2004/0194351 A1 * 10/2004 Gallegos ..... A43B 3/24 36/140
2004/0226076 A1 * 11/2004 Chen ..... A43B 3/128 2/239
2005/0120589 A1 * 6/2005 Coomes ..... A43B 3/0078 36/15

(Continued)

*Primary Examiner* — Marie D Bays
(74) *Attorney, Agent, or Firm* — Mark S. Hubert PC

(57) ABSTRACT

A convertible shoe intended for use by babies and young children. Acknowledging that there is very little wear on the soles of the shoes for children learning to walk because of their weight and the few steps they take, this shoe has interchangeable upper shoes that can be mated to a common sole. It saves the cost of buying complete shoes, which can get expensive for growing feet. Rather, one can buy multiple decorative upper shoes to unite with a common sole, at a cost savings. Additionally, this offers a simpler way to put shoes on babies and insure that their toes are not jammed or feet twisted.

9 Claims, 11 Drawing Sheets

(56) References Cited

U.S. PATENT DOCUMENTS

| | | | | |
|---|---|---|---|---|
| 2005/0246923 | A1* | 11/2005 | Bergamin | A43B 1/0081 36/131 |
| 2005/0274042 | A1* | 12/2005 | Issler | A43B 13/28 36/15 |
| 2006/0021260 | A1* | 2/2006 | Kim | A43B 5/008 36/130 |
| 2006/0042119 | A1* | 3/2006 | Workman | A43B 13/026 36/15 |
| 2006/0112591 | A1* | 6/2006 | Lombardo | A43C 15/02 36/7.5 |
| 2007/0227039 | A1* | 10/2007 | Chaney | A43B 5/08 36/15 |
| 2008/0005927 | A1* | 1/2008 | Hung | A43B 13/36 36/15 |
| 2008/0222920 | A1* | 9/2008 | Rovida | A43B 5/18 36/100 |
| 2009/0133288 | A1* | 5/2009 | Gallegos | A43B 13/223 36/91 |
| 2010/0122473 | A1* | 5/2010 | Santos | A43B 3/24 36/100 |
| 2014/0041257 | A1* | 2/2014 | Robinson | A43B 3/244 36/100 |
| 2014/0325877 | A1* | 11/2014 | Santos | A43B 3/246 36/103 |
| 2015/0320142 | A1* | 11/2015 | Handelman | A43B 5/005 36/15 |
| 2017/0027282 | A1* | 2/2017 | Santos | A43B 3/246 |

* cited by examiner

CONVERTIBLE SHOE

FIELD

The present disclosure relates, in general, to footwear, and more particularly to convertible, interchangeable shoe technology.

BACKGROUND

Shoes are as used as much for fashion statements as they are for foot protection. As such, most shoes are cast aside before they are worn out. This is especially true for babies with rapidly growing feet. However, to own multiple pairs of shoes can become expensive. Since babies don't walk, or only walk a limited distance, the soles of the shoes never really wear out. Thus, the only visible wear on these shoes is on the tops of the shoes. Having multiple different shoe tops that can be purchased at a fraction of the cost of an entire shoe would be an appealing option to people with small children. Especially since the part of the shoe to wear out first, the outsole, rarely does with small children.

In many situations, such as encountered with pets, a full shoe is hard to put on in one piece. The pet will rebel against its foot's complete insertion into outdoor footwear, making them hard to properly install. With children, they too will fidget when the shoe is being installed making the job difficult. Of primary concern, is whether the child's foot is properly fitted into the shoe. Their toes may be jammed, bent, crossed and the like as well as crookedly fit into the shoe. This can lead to more than just discomfort.

Henceforth, an inexpensive, convertible shoe that can be converted to accommodate different looks and assembled in place, on or off of the foot would fulfill a long felt need in the footwear industry. This new invention utilizes and combines known and new technologies in a unique and novel configuration to overcome the aforementioned problems and accomplish this. Thus, an economical solution to the aforementioned problems is provided by the embodiments set forth below.

BRIEF SUMMARY

In accordance with various embodiments, a shoe with interchangeable looks is provided.

In one aspect, a shoe sole, combinable with a plethora of different styled upper shoe tops that may be placed onto the foot in two parts and combined thereon is provided.

In another aspect, a shoe adapted to accommodate a rapidly growing foot is provided.

In still another aspect, a shoe made by mating a different sized outsole and upper shoes together.

In yet another aspect, an economical system of footwear utilizing one sole and multitude of foot coverings connectable thereto.

Various modifications and additions can be made to the embodiments discussed without departing from the scope of the invention. For example, while the embodiments described above refer to particular features, the scope of this invention also includes embodiments having different combination of features and embodiments that do not include all of the above described features.

BRIEF DESCRIPTION OF THE DRAWINGS

A further understanding of the nature and advantages of particular embodiments may be realized by reference to the remaining portions of the specification and the drawings, in which like reference numerals are used to refer to similar components.

DETAILED DESCRIPTION

Figure 1:
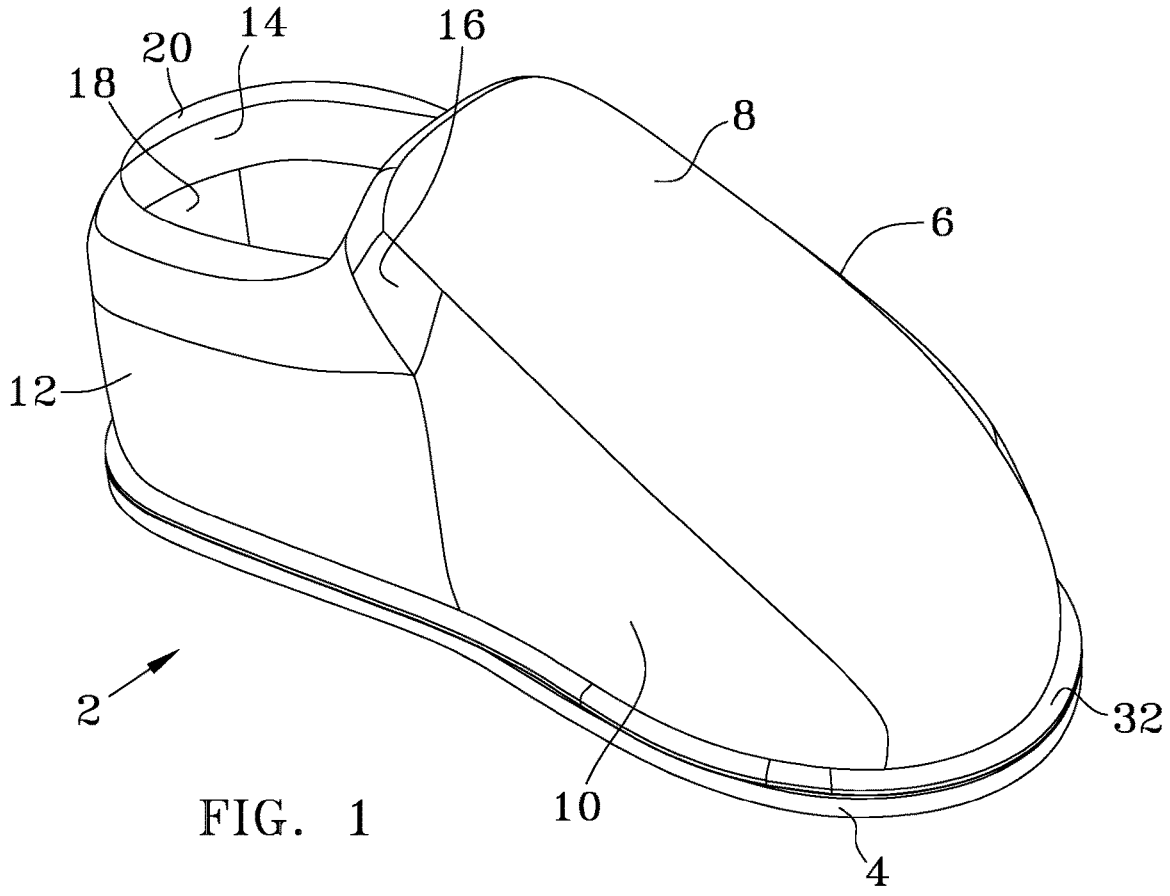
FIG. 1 is perspective top view of the preferred embodiment convertible shoe.

While various aspects and features of certain embodiments have been summarized above, the following detailed description illustrates a few exemplary embodiments in further detail to enable one skilled in the art to practice such embodiments. The described examples are provided for illustrative purposes and are not intended to limit the scope of the invention.

Reference will now be made in detail to embodiments of the inventive concept, examples of which are illustrated in the accompanying drawings. The accompanying drawings are not necessarily drawn to scale. In the following detailed description, numerous specific details are set forth to enable a thorough understanding of the inventive concept. It should be understood, however, that persons having ordinary skill in the art may practice the inventive concept without these specific details It will be understood that, although the terms first, second, etc. may be used herein to describe various elements, these elements should not be limited by these terms. These terms are only used to distinguish one element from another. For example, a first attachment could be termed a second attachment, and, similarly, a second attachment could be termed a first attachment, without departing from the scope of the inventive concept.

It will be understood that when an element or layer is referred to as being "on," "coupled to," "affixed to" or "connected to" another element or layer, it can be directly on, directly coupled to or directly connected to the other element or layer, or intervening elements or layers may be present. In contrast, when an element is referred to as being "directly on," "directly coupled to," or "directly connected to" another element or layer, there are no intervening elements or layers present. Like numbers refer to like elements throughout. As used herein, the term "and/or" includes any and all combinations of one or more of the associated listed items.

The terminology used in the description of the inventive concept herein is for the purpose of describing particular embodiments only and is not intended to be limiting of the inventive concept. As used in the description of the inventive concept and the appended claims, the singular forms "a," "an," and "the" are intended to include the plural forms as well, unless the context clearly indicates otherwise. It will also be understood that the term "and/or" as used herein refers to and encompasses any and all possible combinations of one or more of the associated listed items. It will be further understood that the terms "comprises" and/or "comprising," when used in this specification, specify the presence of stated features, elements, and/or components, but do not preclude the presence or addition of one or more other features, elements, components, and/or groups thereof.

Unless otherwise indicated, all numbers herein used to express quantities, dimensions, and so forth, should be understood as being modified in all instances by the term "about." In this application, the use of the singular includes the plural unless specifically stated otherwise, and use of the terms "and" and "or" means "and/or" unless otherwise indicated. Moreover, the use of the term "including," as well as other forms, such as "includes" and "included," should be considered non-exclusive. Also, terms such as "element" or "component" encompass both elements and components comprising one unit and elements and components that comprise more than one unit, unless specifically stated otherwise.

As used herein, the term "shoe" refers to any article of footwear whether it be a shoe, boot, sandal or the equivalent.

As used herein, a "hook and loop fastener strip" is but one type of planar attachment mechanism for mechanically attaching the outer sole to the upper shoe. It is known that there are a plethora of equivalent but structurally different connection devices that may be substituted for the hook and loop fastener strips including dome fasteners, hooks, zippers, snaps, reusable glue strips, and the like. All of these are termed "fastening means."

The present invention relates to a novel design for an interchangeable shoe system that incorporates a connectable, separable outer sole and upper shoe. The targeted consumers for such a shoe system would be adults or those looking for baby or pet shoes. It may be packaged with several different sizes of outer soles and length-extendable upper shoes, or with one size of outsole and a non-length-extendable upper shoe. The size of the outsole and the upper shoe cover do not have to necessarily match. That is to say that a size 5-7 upper shoe will fit on a size 6 outsole.

The convertible shoe system has two combinable elements, an outsole and an upper shoe, that when attached, either before mounting onto a foot or after partial mounting to a foot, form a complete article of footwear, be it a shoe, boot or sandal. The novel aspect of this system is that the separable outsole and upper shoe may be attached about the side or perimeter of the top face of the outsole by at least one hook and loop fastener strip, with or without alignment devices and with or without an outsole cover to make a plethora of different shoes. An alternate embodiment upper shoe (utilizing stretch or elastic materials) may be able to be lengthened to fit on different sized outsoles to accommodate growing feet. Although all of the drawings herein, utilize a single design of upper shoe, it is known that there are a plethora of different upper shoe designs available.

There is a preferred embodiment as well as a first and second alternate embodiment. However, the first and second alternate embodiments may be seen as simply mismatched sizes of upper shoes and outsoles from the preferred embodiment, although these mismatches may be packaged together as a complete shoe. The functional advantages of using smaller or larger sizes of upper shoes than the size of the outsole are discussed herein.

FIGS. 1-7 show the convertible shoe 2 assembled as a matched upper shoe 6 mated to an outsole 4 of a corresponding size. As can be seen the upper shoe 6 is stitched together in series of panels with a circumferential edge band 32. Keeping in mind this shoe is designed for babies, infants and pets, (entities that will require an adult to put on the shoe for them) one will appreciate that the upper shoe 6 is designed to have an ample amount of material stretch to ensure that toes and feet are positioned properly and not jammed within the convertible shoe 2. Within this series of panels, some of the panels may be elastic (or made of a functionally equivalent elastically deformable fabric material) and some of the panels may be made of an inelastic fabric material or a material with a less elastic deformation.

The preferred embodiment upper shoe 6 is a fabric foot covering 7 mated to an insole 24 and the edge band 32 at their interface. The fabric foot covering 7 is made of a series of stitch connected panels including heel tab 14, a quarter 12, a top vamp 8, two side vamps 10, a heel cap 18, a collar 20, an expansion mechanism 16, an insole 24 and an edge band 32. Although depending on the makers, combinations of these panels may be made as single panels. In the preferred embodiment, the conjoined panels define an expandable foot opening 22 that elastically returns to its original dimensions. (FIG. 11) However, alternate embodiment upper shoe 6 may not have an elastic opening and the expandable feature may be accomplished by fabric stretch or a lacing such as may be found on a boot. The edge band covers the interface between the fabric foot covering 7 and the insole 24. This series of panels comprising the foot covering 7 may differ with different upper shoe designs however, an expansion mechanism 16 generally will be found on all upper shoes 6 between their top vamp 8 and quarters 12 (or between their top panel and side panels.) The expansion mechanisms 16 are the most elastic fabric panel used on the upper shoe 6 so as to allow the foot opening 22 to increase in size as the top vamp 8 is stretched upward and forward away from the quarter 12. This eases the entry of the foot into the convertible shoe 2.

Although discussed with expansion mechanisms 16 of elastic panels, it is known that this gathering mechanism may also be an elastic loop sewn into a hem formed about the perimeter of the opening 22, or a lace, however, a drawstring or elastic cord could also be passed through a similarly positioned open-ended hem so as to make a drawstring, shoelace or shock cord to facilitate the gathering of the opening 22.

The insole 24 is a planar, flexible, panel made from an elastically compressible material shaped to the general outline of a foot that is capable of deforming when the wearer's weight is placed thereon. It has a top face 26 and a bottom face 28. Extending across the entire surface of the bottom face 28 is glued, stitched or formed a first portion planar attachment panel 30.

Figure 9:
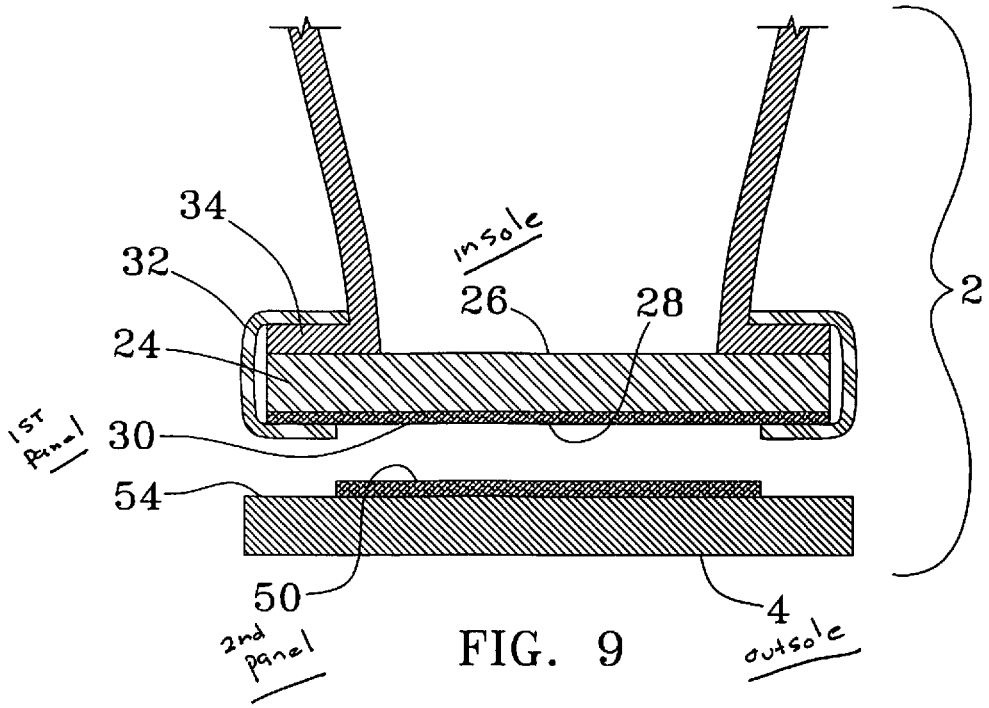
FIG. 9 is a cross sectional exploded view of the preferred embodiment convertible shoe.
Figure 10:
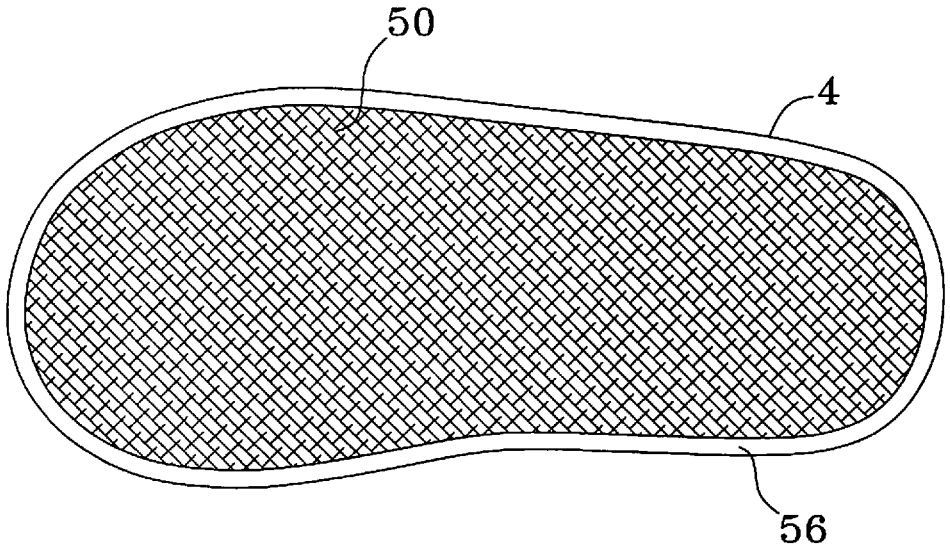
FIG. 10 is a top view of the outsole.

Looking at FIG. 9 it can be seen that the foot covering 7 extends vertically upward from the horizontal plane of the insole 24 with its bottom peripheral edge bent into a horizontal flange 34 that is parallel with the horizontal plane of the insole 24. This horizontal flange 34 rests directly about the entire periphery of the top face 26 of the insole 24. The edges of the horizontal flange 34 and the insole 24 are vertically aligned. Encasing the top face of the horizontal flange 34, extending over the edges of the horizontal flange 34, the insole 24 and the planar first portion attachment panel 30, and forming a ring onto the engagement face of the planar attachment panel 30 is the fabric edge band 32. This edge band may or may not be made of the same material as the foot covering 7.

As can be seen in the preferred embodiment, the insole 26 and unitary outsole 4 have the same planar configuration but the insole is dimensionally scaled smaller than the outsole 4. However, with the edge band 32 attached, the configuration and dimensions of the foot covering 7 are equal to that of the outsole 4. The first portion planar attachment panel 30 sits above the edge band 32. In this way the entire exposed areas of the attachment panels are identical in size and shape although the first attachment panel on the bottom face of the insole is larger than the second attachment panel on the tip face of the outsole as can be seen in FIG. 9.

This edge band 32 serves several purposes depending on the embodiment of the shoe (or which mating of sizes between the upper shoe 6 and the outsole 4 is used.) It has an aesthetic purpose to cover up the unsightly interface at the edges of the insole 24 and the upper shoe 6. It prevents the dislodging of the edge of the first portion attachment panel 30 from the bottom face 28 of the insole 24. It strengthens and helps prevent the release of the flange 34 from dislodging from the edge of the top face 26 of the insole 24. It serves as a stitching medium to run the thread that binds the upper shoe 6, the insole 24 and the first portion attachment panel 30 together. It serves as a bump protector to keep the outsole of the convertible shoe from contacting wall, baseboards, tables and other objects and surfaces that could be marred by a dirty outsole. It provides a grasping location from which to separate the upper shoe 6 from the outsole 40 or to help align the upper shoe 6 on the outsole 40 during disassembly or assembly (shoe conversions.) The edge band 32 also serves as a template or guide for the alignment of the second portion planar attachment panel 50 on the outsole 4 when the outsole 4 and the foot covering 7 are being joined. Lastly, it cushions the sewing machine foot and needle from damaging the upper shoe 6.

Looking at the outsole 4 as depicted in FIGS. 5-10 it can be seen that the bottom face 52 of the outsole 4 is smooth and unadorned. It is understood that there can be a plethora or treads or patterns formed thereon. The outsole 4 is a planar substrate made of a resilient material generally a rubber or polymer exhibiting rubber-like resiliency characteristics. The top face 54 of the outsole 4 has the second portion planar attachment panel 50 glued thereon. This second portion planar attachment panel, upon surface contact, removably attaches to the first portion planar attachment panel 30. There are various types of mechanical attachment panels although the hook and loop fastener combination is best suited for this application.

The second portion attachment panel 50, although it has the identical geometrical configuration as the outsole 4 and the insole 24, is scaled to a smaller dimension. This dimension approximates the configuration and dimensions of the exposed area of the first portion planar attachment panel 30 on the insole 24. That is to say, it approximates the area of the first portion planar attachment panel 30 that is bounded by the edge band 32. This exposed area of the first portion planar attachment panel 30 sits below the edge band 32. The edge band has a material thickness that approximates the thickness of the first portion planar attachment panel 30. The second portion planar attachment panel 50 resides centered on the top face 54 of the outsole 4 such that there is a peripheral space or ring around the outsole 4 where there is no second portion planar attachment panel 50. When the foot covering 7 is engaged onto the outsole 4, the second portion planar attachment panel 50 is bounded by the inside perimeter of the edge band 32 and fits onto the first portion planar attachment panel 30. In this way the insole 24 of the foot covering 7 remains planar when assembled onto the outsole 4 and does not rise upward about its outside edge. This also allows for more of a surface to engage the two attachment panels 30 and 50 then would be if the second attachment panel extended to the edge of the outsole 4 as there would be a void created at the interface of the edge band 32 and the first attachment panel 28.

Figure 2:
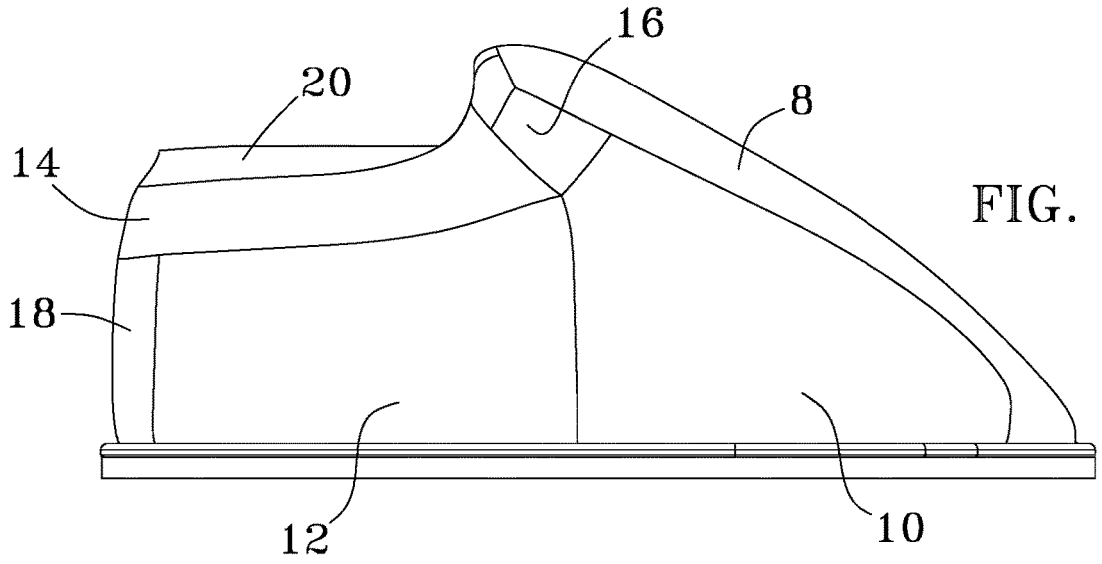
FIG. 2 is a side view of the preferred embodiment convertible shoe.
Figure 3:
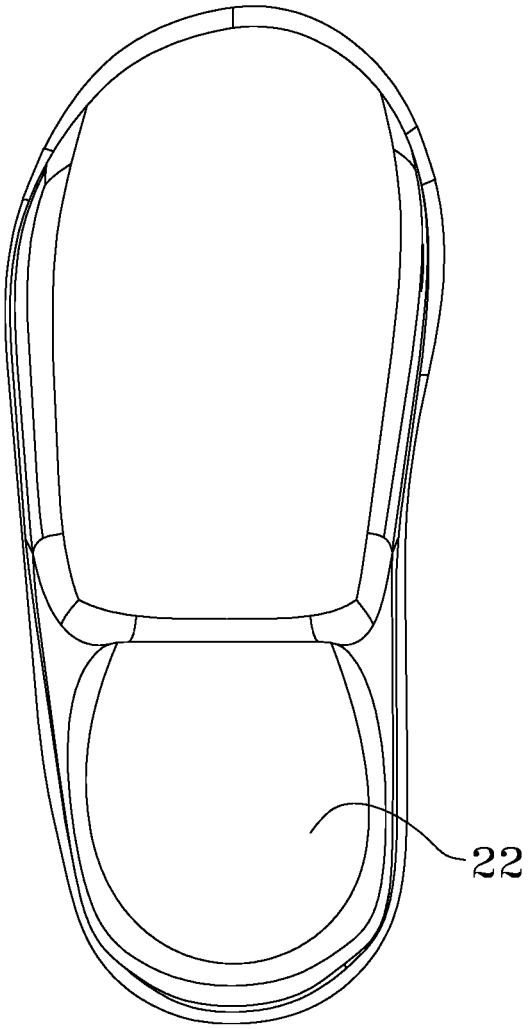
FIG. 3 is a top view of the preferred embodiment convertible shoe.
Figure 4:
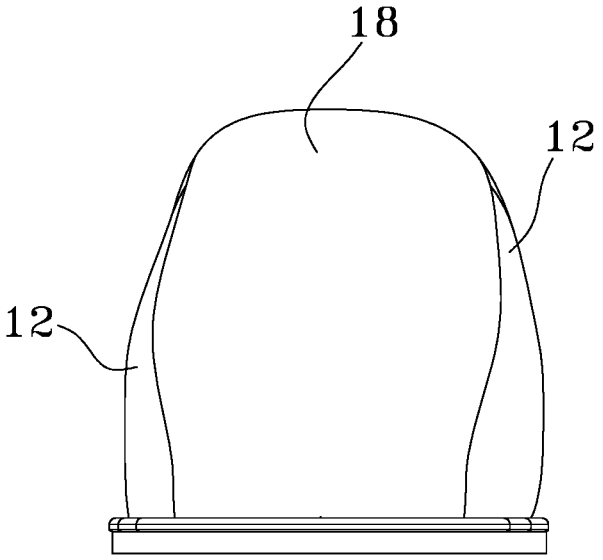
FIG. 4 is a rear view of the preferred embodiment convertible shoe.
Figure 5:
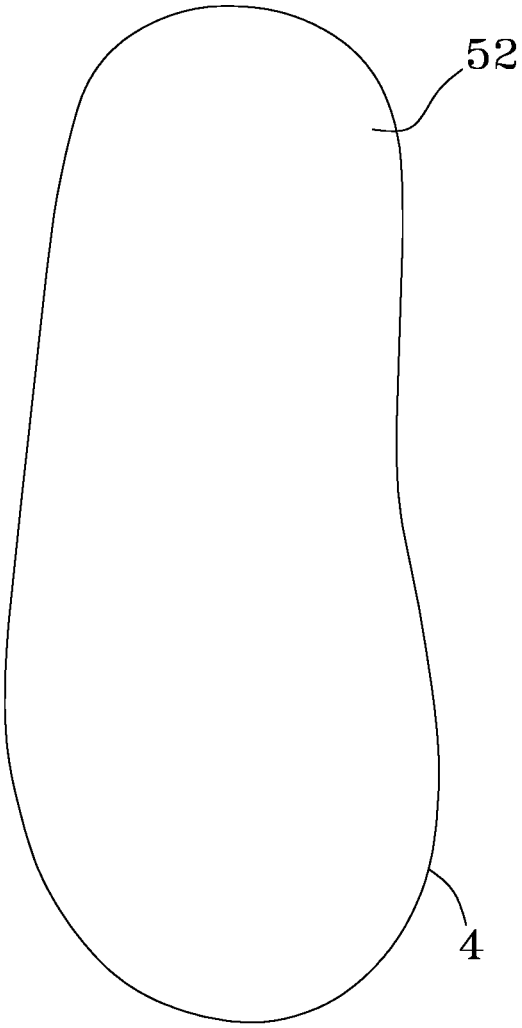
FIG. 5 is a bottom view of the preferred embodiment convertible shoe.
Figure 6:
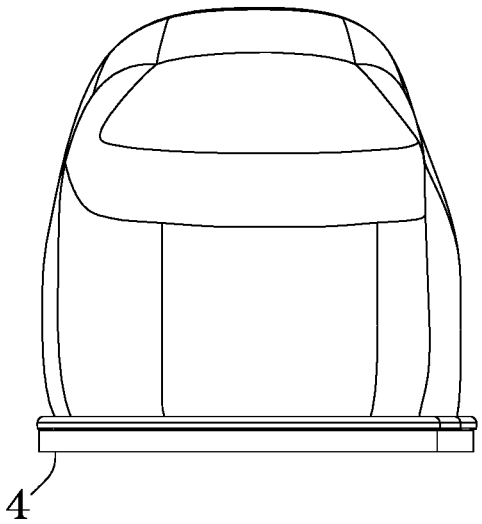
FIG. 6 is a back view of the preferred embodiment convertible shoe.
Figure 7:
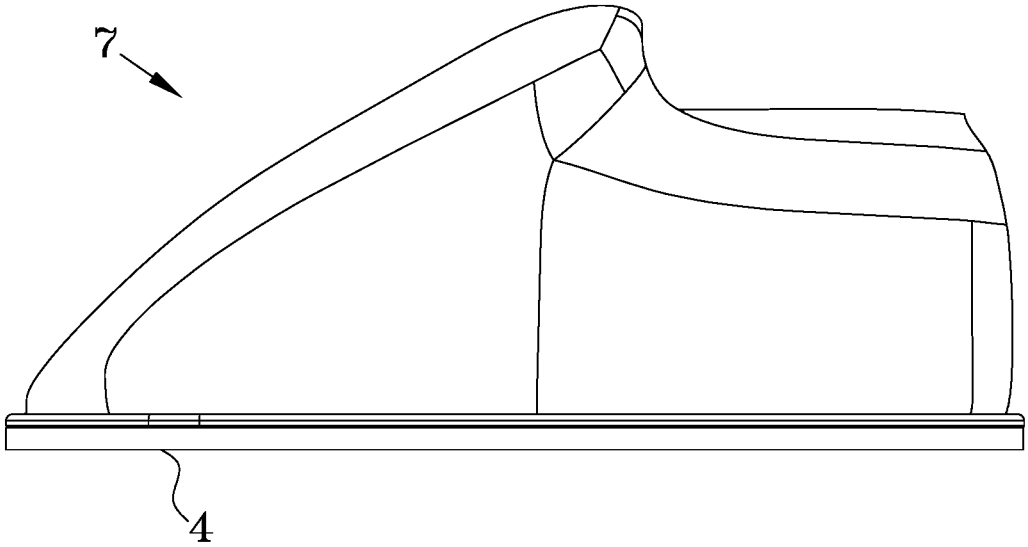
FIG. 7 is a side view of the preferred embodiment convertible shoe.
Figure 8:
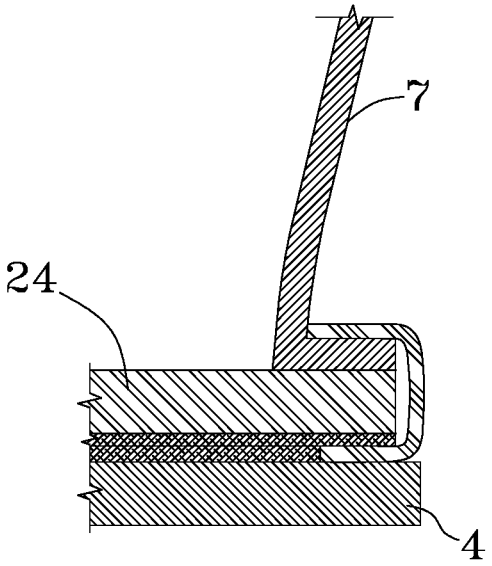
FIG. 8 is a cross sectional view of the edge detail of the preferred embodiment convertible shoe.
Figure 11:
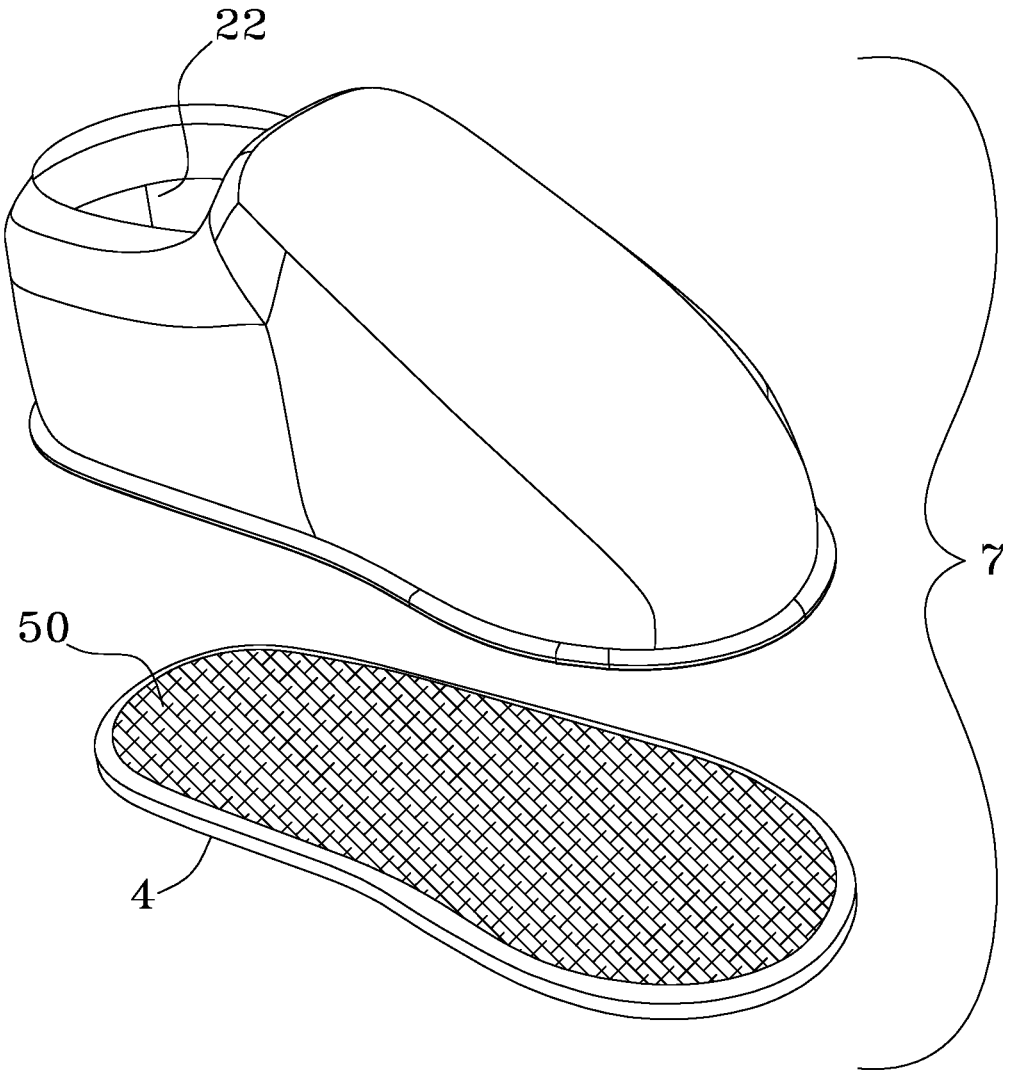
FIG. 11 is a perspective, exploded view of the preferred embodiment convertible shoe.

FIG. 11 shows the exploded view of the outsole 4 and the foot covering 7 and FIGS. 2, 8 and 9 show the convertible shoe 2 as the foot covering 7 and the outsole 4 are mated. Referring again to FIGS. 7-9 it can be seen that the edge of the outsole 4 and outside edge of the edge band 32 on the foot covering 7 are vertically aligned. Each of these constitute the outer extent and set the exterior footprint of the convertible shoe 12.

Figure 12:
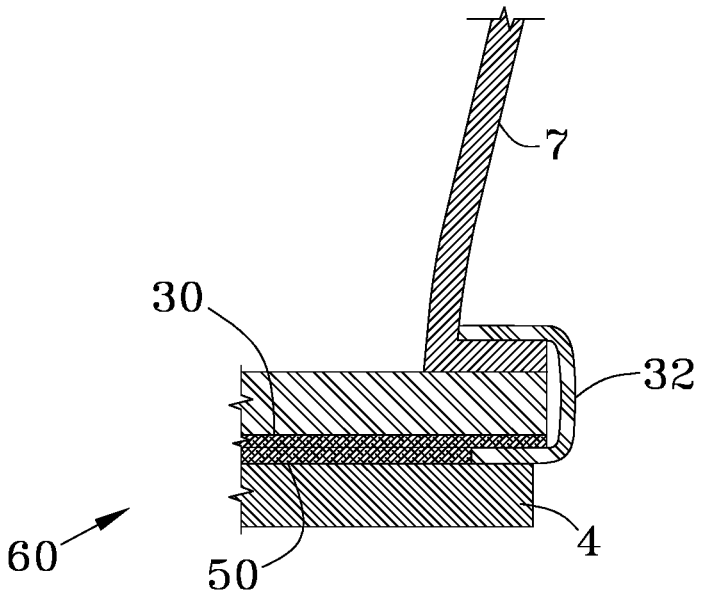
FIG. 12 is a cross sectional view of the edge detail of the first alternate embodiment convertible shoe.
Figure 13:
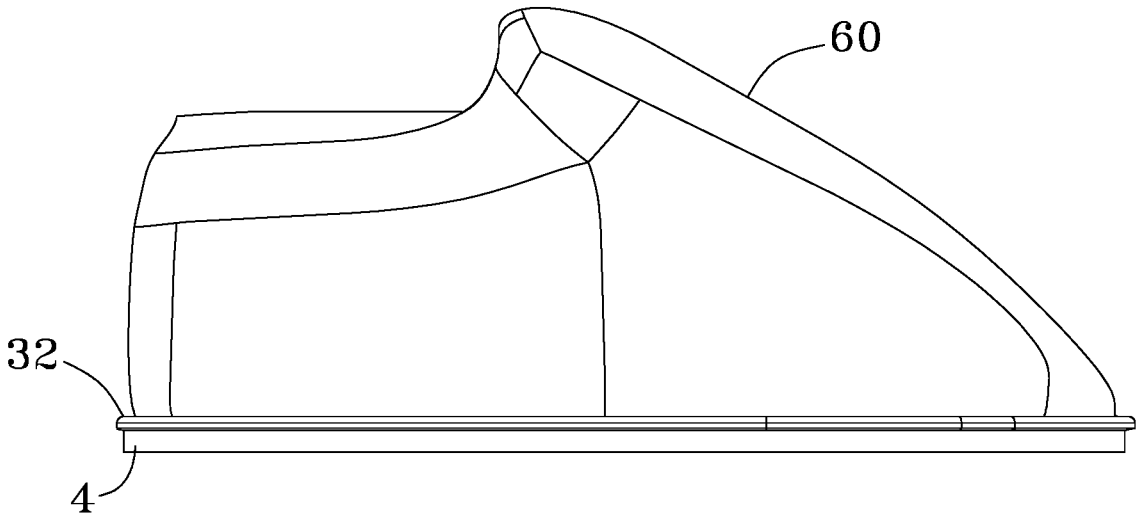
FIG. 13 is a side view of the first alternate embodiment convertible shoe.

FIGS. 12 and 13 show the first alternate embodiment convertible shoe 60. Here, it can be seen that outside edge of the edge band 32 on the foot covering 7 overhangs the edge of the outsole 4. This allows for the pinching or gripping of the top and bottom edge of the edge band 32 when separating the first alternate embodiment convertible shoe 60. It also prevents the marring or walls and baseboards by the side of the outsole 4 as the edge band 32 acts as a bumper. The remainder of the shoe design remains unchanged except for the size of the outsole 4. The second portion attachment panel 50, still approximates the configuration and dimensions of the exposed area of the first portion planar attachment panel 30 on the insole 24. That is to say, it approximates the area of the first portion planar attachment panel 30 that is bounded by the edge band 32 and it remains centered on the top face 54 of the outsole 4 such that there is a peripheral space or ring around the outsole 4 where there is no second portion planar attachment panel 50. When the foot covering 7 of this first alternate embodiment convertible shoe 60 is engaged onto the outsole 4, the second portion planar attachment panel 50 is bounded by the inside perimeter of the edge band 32 and fits onto the first portion planar attachment panel 30.

Figure 14:
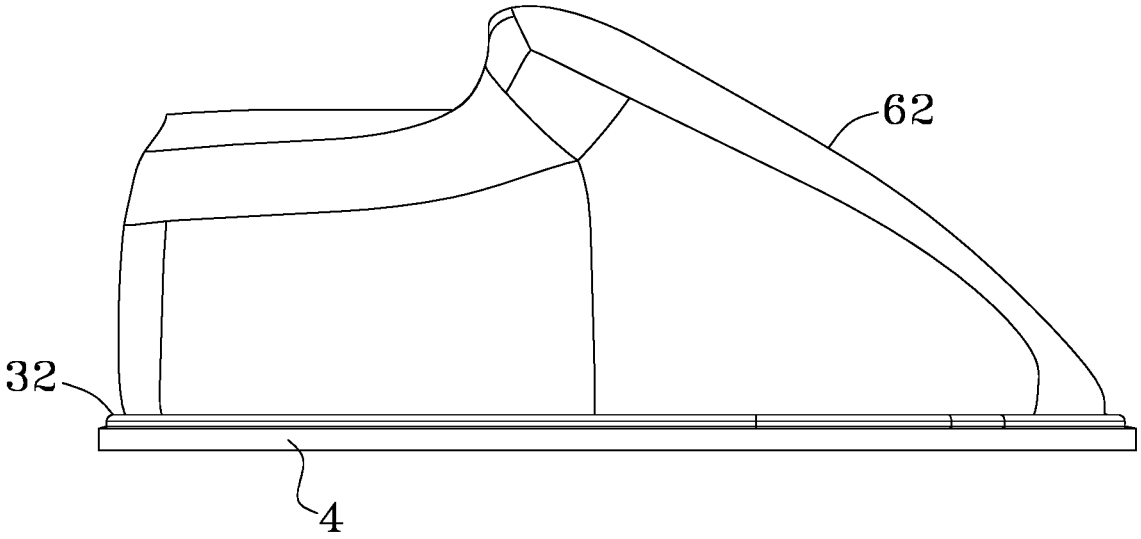
FIG. 14 is a side view of the second alternate embodiment convertible shoe.

FIG. 14 shows the second alternate embodiment convertible shoe 66. Here, it can be seen that outside edge of the outsole 4 extends beyond the edge band 32 on the foot covering 7. This minimizes the potential for accidentally catching the edge band 32 on an object and dislodging the foot covering from the outsole 4. As in the first alternate embodiment, the remainder of the shoe design remains unchanged except for the size of the outsole 4.

In operation, the assembly of the shoe may be accomplished either before the footwear cover 7 is placed onto the foot or after. In the case of pets, it is easier to slide the four upper shoes onto their legs then place the pet's foot onto the top face of the outsole and align and connect their attachment panels 30 and 50. The upper shoes, having a thinner, more flexible sole makes the job of ensuring the foot is fully inserted into the shoe a lot easier than if the rigid outsole was already coupled to the upper shoe. The assembly of the shoe 2 is accomplished the same way regardless of which size of sole 4 and foot covering 7 are combined. Basically, the outsole 7 is brought into proximity with the foot covering 7 and the outside perimeter of its second portion planar attachment panel 50 is aligned with the inside perimeter of the edge band 32 and fitted directly below the first portion planar attachment panel 30 and the two attachment panels 30 and 50 are pressed together. The inside perimeter of the edge band 32 is the alignment mechanism for the foot covering 7 and the outsole 4.

Figure 15:
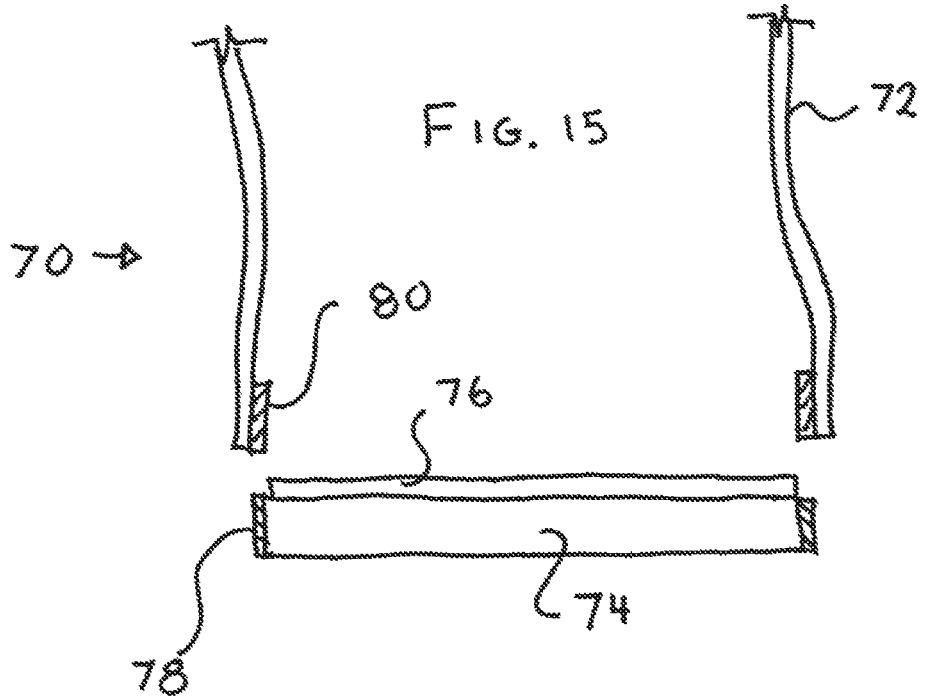
FIG. 15 is a cross sectional view of the third alternate embodiment shoe.

Looking at FIG. 15 the third alternate embodiment shoe 70 can be seen in cross section and best explained in reference thereto. Here, in order to simplify the installation of the convertible shoe on a difficult client (I.E. a pet or fussy child) the pet upper shoe 72 has no insole. Rather, the upper shoe is an open ended flexible, fabric sleeve that can easily be slid over the foot and onto the leg without fear of jamming the toes or putting it on uncomfortably. The pet outsole 74 has an upper compressible layer 76 affixed onto its top face for the comfort of the wearer and a second portion hook and loop fastener strip 78 affixed about its side edge. This matingly engages to the first portion hook and loop fastener strip 80 affixed about the inner, lower, peripheral edge of the pet upper shoe 72. Although shown as having the first portion hook and loop fastener strip 80 affixed directly to the lower peripheral edge of the upper shoe, it is known that there may be an edge band with the first portion hook and loop fastener strip 80 affixed about its distal edge and its proximal edge affixed to the lower peripheral edge of the upper shoe 70.

Figure 19:
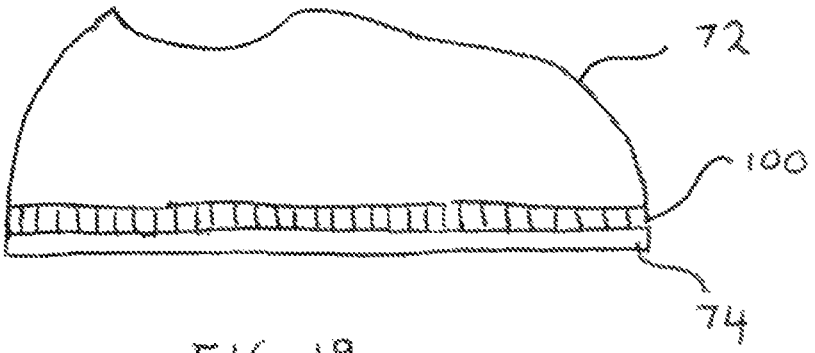
FIG. 19 is a side view of the third embodiment shoe with upper shoe having an elastic perimeter.
Figure 20:
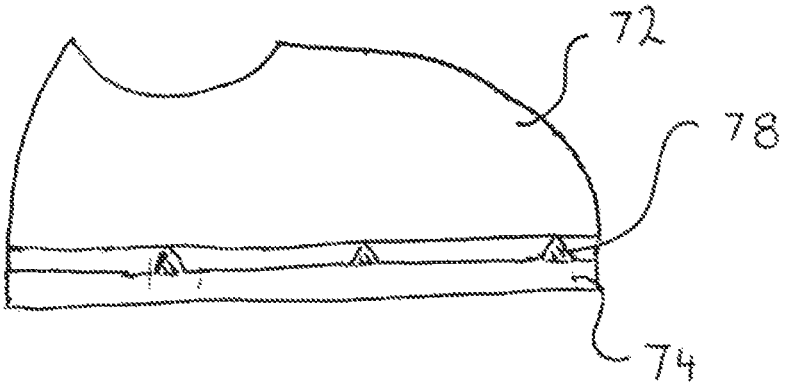
FIG. 20 is a side view of the third embodiment shoe with upper shoe having a non-elastic perimeter.

Looking at FIGS. 19 and 20, there is illustrated two different methods that the inner, lower, peripheral edge of the pet upper shoe 72 may use to expand slightly in size to get around the perimeter of the outsole. In FIG. 19 there is an elastic edge band 100 to which the first portion hook and loop fastener strip 80 is affixed to the inner face. The first portion hook and loop fastener strip 80 may be segmented into shorter pieces or it may be in a continual loop. The edge band 100 then is able to be stretched to be able to fit over the outsole 74. In FIG. 20 there is no edge band (as in FIG. 15) but the inner, lower, peripheral edge of the pet upper shoe 72 has slits 78, which when stretched to fit over the outsole 74 look like V notch regions 78, allowing for easier fitment. Notable here also is the lack of separately connected upper shoe panels. Here the upper shoe 72 is made from a single piece of fabric, stitched accordingly to join it into the open ended flexible, fabric sleeve that is slid over the foot and onto the leg prior to installation on the outsole 74.

Figure 16:
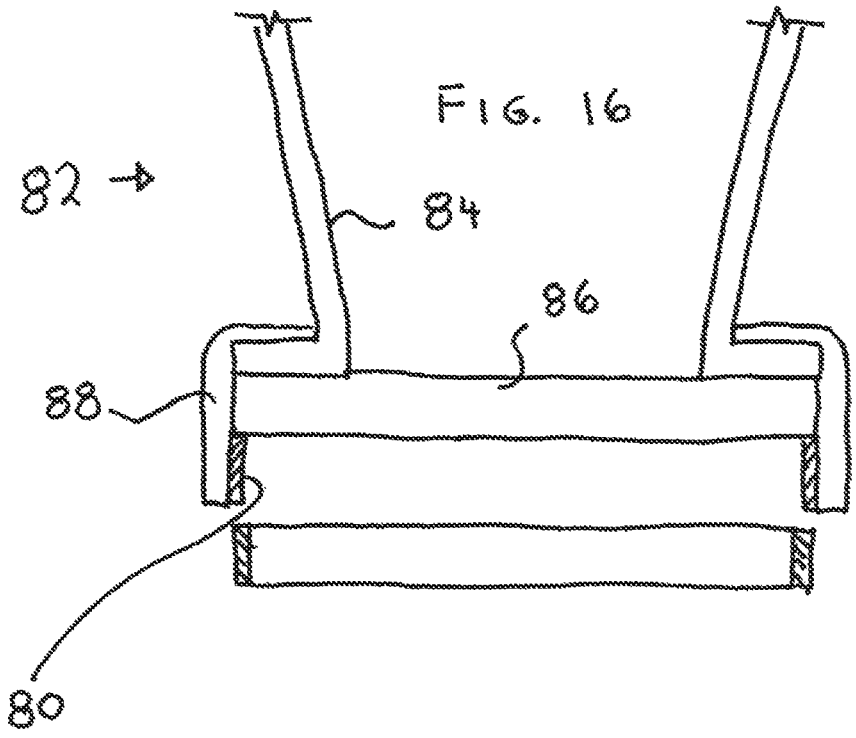
FIG. 16 is a cross sectional view of the fourth alternate embodiment shoe.

Looking at FIG. 16, as the cross section shows, here the fourth alternate embodiment shoe 82 has its upper shoes 84 with its own cushioning insole 86 that replaces the upper compressible layer affixed onto the top face of the outsole in the third embodiment pet shoe 70. Here there is an edge band 88 with the first portion hook and loop fastener strip 80 affixed about its distal edge and its proximal edge affixed to the lower peripheral edge of the upper shoe. The cushioning insole 86 in this embodiment is affixed directly to the upper shoe.

Figure 17:
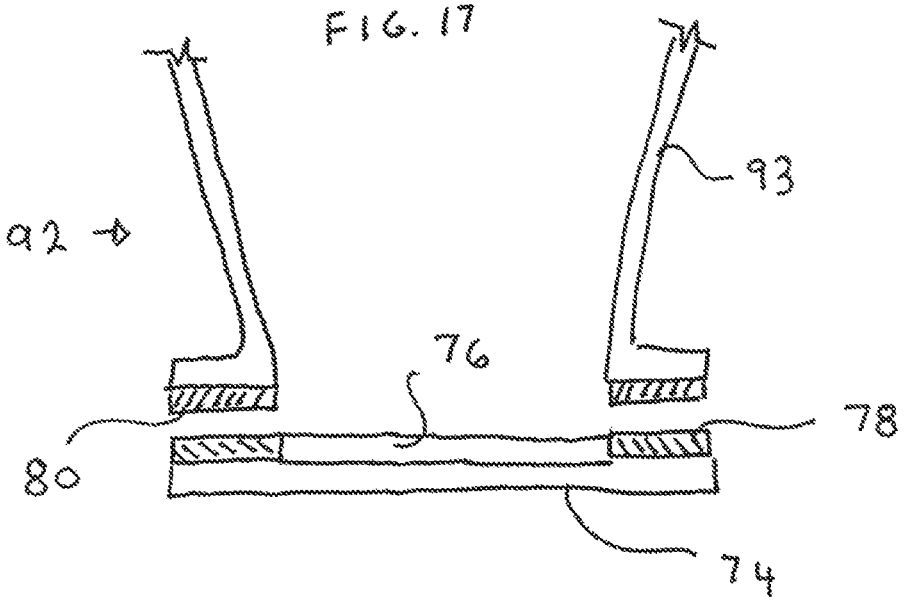
FIG. 17 is a cross sectional view of the fifth alternate embodiment shoe.

Looking at FIG. 17 the fifth alternate embodiment shoe 92 can be seen in cross section and best explained in reference thereto. Here, again in order to simplify the installation of the convertible shoe on a difficult client the upper shoe 72 has no insole. Rather, the upper shoe 93 is an open ended flexible, fabric sleeve that can easily be slid over the foot and onto the leg without fear of jamming the toes or putting it on uncomfortably. The outsole 74 has an upper compressible layer 76 affixed onto its top face for the comfort of the wearer and a second portion hook and loop fastener strip 78 affixed about the outer periphery of the top face of the outsole 74. This matingly engages to the first portion hook and loop fastener strip 80 affixed about the inner, lower, peripheral edge of the upper shoe 93. The upper compressible layer 76 in this configuration does not extend across the entire outsole 74, rather its extents only within the footprint of the second portion hook and loop fastener strip 78.

Figure 18:
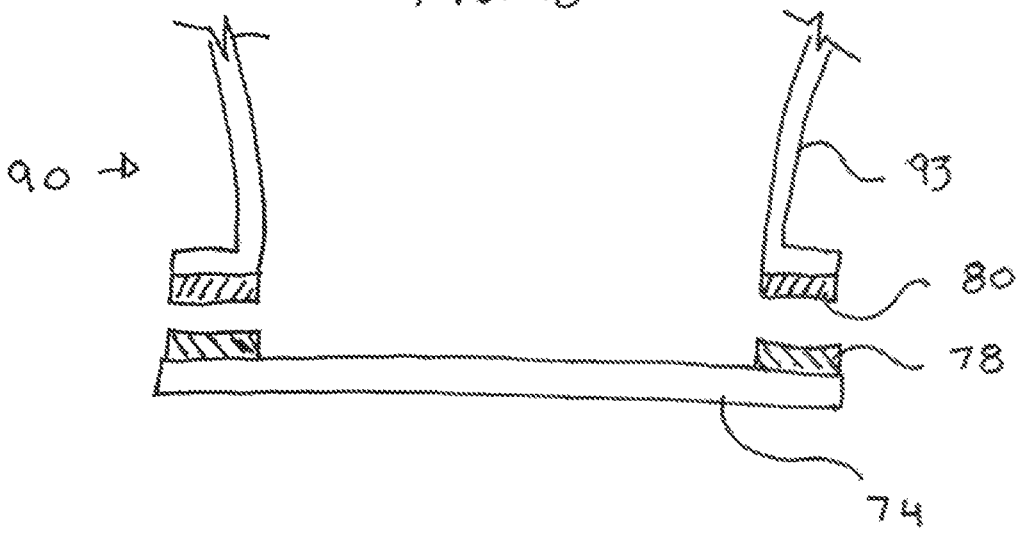
FIG. 18 is a cross sectional view of the sixth alternate embodiment shoe.

Looking at FIG. 18, as the cross section shows, here the sixth alternate embodiment shoe 90 mirrors the design of the fifth alternate embodiment shoe 92 but eliminates the upper compressible layer. This is intended for uses in the smaller size shoes that see little wear where the outsole 74 is fabricated from a softer compound material.

The disassembly of the shoe 2 is accomplished by pulling upward on the heel cap 18, heel tab 14, or collar 20, while firmly holding the outsole 4. With the first edge of the mating engagement attachment panels dislodged, the remained will just peel off. With the first alternate embodiment 60 the edge band 32 is grasped and pulled upward while holding the opposite sides of the outsole 4 to dislodge the mating attachment panels. With the second alternate embodiment 62 the exposed perimeter edge of the outsole 4 and the heel cap 18, heel tab 14, or collar 20 are grasped and pulled apart.

One of the most novel features of this convertible shoe is that it can be bought in components. Several different foot coverings 7 may be purchased yet only one outsole is needed to make a shoe.

The foot covering of the shoes are available in various styles such as boots and sandals. The outsoles remain identical for each shoe assembly, but the foot covers are different. In all cases the foot covers will have the identical method of attachment to the sole. Thus, a shoe system exists wherein a single sole may be sold with more than one different foot cover, allowing flexibility in style but at the fraction of the cost of having three different pairs of shoes. Similarly, where first alternate embodiments of foot covers are sold with different sized soles, a range of shoe sizes may be assembled for growing feet or multiple users.

While certain features and aspects have been described with respect to exemplary embodiments, one skilled in the art will recognize that numerous modifications are possible. Moreover, while the procedures of the methods for assembling the shoes described herein are described in a particular order for ease of description, unless the context dictates otherwise, various procedures may be reordered, added, and/or omitted in accordance with various embodiments. Hence, while various embodiments are described with—or without—certain features for ease of description and to illustrate exemplary aspects of those embodiments, the various components and/or features described herein with respect to a particular embodiment can be substituted, added, and/or subtracted from among other described embodiments, unless the context dictates otherwise. Consequently, although several exemplary embodiments are described above, it will be appreciated that the invention is intended to cover all modifications and equivalents within the scope of the following claims.

Having described and illustrated the principles of the inventive concept with reference to illustrated embodiments, it will be recognized that the illustrated embodiments can be modified in arrangement and detail without departing from such principles, and can be combined in any desired manner. And although the foregoing discussion has focused on particular embodiments, other configurations are contemplated.

Consequently, in view of the wide variety of permutations to the embodiments described herein, this detailed description and accompanying material is intended to be illustrative only, and should not be taken as limiting the scope of the inventive concept. What is claimed as the invention, therefore, is all such modifications as may come within the scope and spirit of the following claims and equivalents thereto.

Having thus described the invention, what is claimed as new and desired to be secured by Letters Patent is as follows:

1. A convertible shoe, comprising:

an upper shoe having a planar, first portion attachment panel that is either a loop or a hook engageable half of a hook and loop fastener and is affixed to a bottom face thereof said upper shoe;

an outsole having a smaller, planar, second portion attachment panel that has a half of said hook and loop fastener that is engagable with said first portion planar attachment panel, said second portion attachment panel affixed to said upper face of said outsole; and wherein said upper shoe is comprised of an elastically compressible insole having an upper face and a lower face, a fabric foot covering with an expandable, top foot opening, said fabric foot covering made of a series of stitch connected panels including an expansion mechanism therein, and an edge band; and wherein said fabric foot covering has a bottom edge that is folded at a right angle so as to form a horizontal flange that resides about a perimeter of said upper face; and wherein said first portion planar attachment panel extends across said insole to a perimeter of said bottom face; and wherein said edge band resides on top of said horizontal flange and said first portion planar attachment panel, and extends along a side of said insole and onto a perimeter of said lower face in a C shaped configuration; and wherein said second portion planar attachment panel extends on said outsole only to said edge band.

2. The convertible shoe of claim 1 wherein said expansion mechanism is an elastically deformable panel in said series of stitch connected panels.

3. The convertible shoe of claim 2 wherein a side of said edge band and an edge of said outsole are vertically aligned.

4. The convertible shoe of claim 2 wherein said edge of said outsole sole does not extend horizontally beneath said insole far enough to extend to vertically align with said side of said edge band, such that said edge band forms a protective bumper around said shoe.

5. The convertible shoe of claim 2 wherein said edge of said outsole extends horizontally beneath said insole so as to extend beyond said side of said edge band so that said outsole forms a protective bumper around said shoe.

6. The convertible shoe of claim 3 wherein said stitch connected panels include at least a top vamp, two side vamps, a heel cap, a heel tab, a quarter panel, a collar, and an expansion mechanism; and wherein said top vamp is connected to said two side vamps and said expansion mechanism, said two side vamps are each connected to said top vamp, said expansion mechanism and one said quarter panel, said each quarter panel is connected to said one said side vamp, said heel tab and said heel cap, said heel cap is connected to two said quarter panels and said heel tab, said heel tab is connected to said collar, said expansion mechanism, said heel tab and two said quarter panels.

7. The convertible shoe of claim 4 wherein said stitch connected panels include at least a top vamp, two side vamps, a heel cap, a heel tab, a quarter panel, a collar, and an expansion mechanism; and wherein said top vamp is connected to said two side vamps and said expansion mechanism, said two side vamps are each connected to said top vamp, said expansion mechanism and one said quarter panel, said each quarter panel is connected to said one said side vamp, said heel tab and said heel cap, said heel cap is connected to two said quarter panels and said heel tab, said heel tab is connected to said collar, said expansion mechanism, said heel tab and two said quarter panels.

8. The convertible shoe of claim 5 wherein said stitch connected panels include at least a top vamp, two side vamps, a heel cap, a heel tab, a quarter panel, a collar, and an expansion mechanism; and wherein said top vamp is connected to said two side vamps and said expansion mechanism, said two side vamps are each connected to said top vamp, said expansion mechanism and one said quarter panel, said each quarter panel is connected to said one said side vamp, said heel tab and said heel cap, said heel cap is connected to two said quarter panels and said heel tab, said heel tab is connected to said collar, said expansion mechanism, said heel tab and two said quarter panels.

9. The convertible shoe of claim 1 wherein said outsole is a unitary piece that covers said entire said bottom face of said upper shoe.

* * * * *